United States Patent [19]

Shuker et al.

[11] Patent Number: 4,892,291

[45] Date of Patent: Jan. 9, 1990

[54] TWO-SPEED WINCH

[75] Inventors: Brian Shuker, Portsmouth; Richard D. J. Huggett, Horndean, both of England

[73] Assignee: Lewmar Marine Limited, Havant, England

[21] Appl. No.: 224,218

[22] Filed: Jul. 22, 1988

Related U.S. Application Data

[60] Continuation of Ser. No. 921,438, Oct. 22, 1986, abandoned, which is a division of Ser. No. 539,407, Oct. 6, 1983.

[30] Foreign Application Priority Data

Oct. 8, 1982 [GB] United Kingdom ..... 8228815
Dec. 30, 1982 [GB] United Kingdom ..... 8237000

[51] Int. Cl.[4] ..... B66D 1/14
[52] U.S. Cl. ..... 254/342; 74/812
[58] Field of Search ..... 254/342, 344, 352, 353, 254/369, 371; 74/810, 812

[56] References Cited

U.S. PATENT DOCUMENTS

| | | | |
|---|---|---|---|
| 940,638 | 11/1909 | Hintze | 74/812 |
| 2,836,085 | 5/1958 | Snyder | 254/342 X |
| 3,712,155 | 1/1973 | Stommel et al. | 254/352 X |
| 3,973,755 | 8/1976 | Fawcett | 74/812 X |
| 4,227,680 | 10/1980 | Hrescak | 74/810 X |
| 4,341,372 | 7/1982 | Sugioka | 254/353 |
| 4,463,932 | 8/1984 | Shuker | 254/342 X |

*Primary Examiner*—Stuart S. Levy
*Assistant Examiner*—Katherine Matecki
*Attorney, Agent, or Firm*—Cushman, Darby & Cushman

[57] ABSTRACT

A manually powered winch has two geared drive trains. Both originate from a simple set of gear teeth (7) formed into the diameter of a drive input shaft (5). The final drive, common to both gear trains, to an internal gear track (18) on the drum (3) of the winch is one part (12) of a two-part gear (8,12). The part (12) is directly borne by a hub (20) on an axle (10) in the winch. Its gear teeth are on the outer face of an annulus (22) on the inner face of which are ratchets (14) of a pawl-and-ratchet unidirectional drive (14,16) between the two parts (8,12). The other part (8) of the two-part gear is preferably borne not directly on the axle (10) but on the hub (20) of the part (12).

10 Claims, 3 Drawing Sheets

TWO-SPEED WINCH

This is a continuation of application Ser. No. 921,438, filed Oct. 22, 1986, now abandoned, which is a divisional of Ser. No. 539,407, filed Oct. 6, 1983.

This invention relates to a winch having only two drive ratios between an input drive shaft and its drum. The drive ratios are achieved by two geared drive trains.

BACKGROUND OF THE INVENTION

In the past the standard way to incorporate a uni-directional drive into such a drive train was to form a ratchet gear in which a central hub was mounted on a shaft and was surrounded by an annulus carrying on its outside the gear teeth which were to mesh with some other gear in the train. Concentricity of the annulus as assured by the sliding bearing surfaces on the outer periphery of the hub and the inner periphery of the ring. There was a pawl and ratchet uni-directional drive linkage between the hub and the ring.

This arrangement was comparatively simple to manufacture and to assemble.

However, in investigating the efficiency of gear trains in the context of winches we have found that that arrangement has a disadvantage which is that, especially because of the very high torque to which such trains are subject when the ratchet gear is the final drive gear before the drum, its efficiency at a time when the pawls are clicking past the ratchet teeth is very low due to high bearing loads on the centering surfaces.

SUMMARY OF THE INVENTION

We have now found and it is the object of this invention to provide a winch with a uni-directional gear which at a time when it is not transmitting drive through its uni-directional drive is of much lower frictional resistance to contra-rotation of two parts of the gear, than the conventional pattern. The gear per se is similar to a gear construction seen, in a different context, in U.S. Pat. No. B-206,182 (U.S. Pat. No. Re 30,881).

The position for the uni-directional gear according to the invention, because it is a situation which involves the maximum load on one part of the gear, is the final gear in a drive of a two-speed winch, with the gear of the one part of the ratchet drive engaging the internal gear track conventionally provided inside the drum for its drive and the second part of the gear being driven in counter-rotation when drive is not being transmitted through the uni-directional drive means between the parts of the gear. Preferably the two-speed winch has only two gears (which are of two parts each and might alternatively be termed two gear stacks of two individual gear faces) between the shaft and the drum, and preferably both are of the defined construction We achieve the desireable effects of the invention by providing the gear teeth on the outer periphery of the gear on a gear part which is fast with a central hub. This hub is either fast with an axle or else rotatably supported on the axle. The second part of the two-part gear is borne concentrically with the first part. The two parts have on them means for unidirectional driving interengagement, usually a ratchet track on one of the parts and pawls on the other. The second part will preferably be borne on the outside of the hub of the first to be rotatable relative to it, though it may be borne on the axle.

In a preferred embodiment the first mentioned part of the two-part gear has its gear teeth on the outer face of a cylindrical annulus, the inner peripheral wall of which is either the ratchet track or is provided with pawls and into which fits at least a portion of the second part of the ratchet gear equipped with its outwardly facing pawls or ratchet track. That is, in this arrangement the second part projects to radially within the track of the teeth of the first part.

The journallying of the first part of the ratchet gear is either on the bearings of the axle or between its hub parts and its axle (in which case rolling contact or sleeve bearings may be provided) and this part may therefore be supported with high concentricity and low friction, the friction moreover occurring much closer to its axis of rotation than was the case in the conventional pattern. The second part may be journalled upon the first part or may be journalled separately upon the same axle as it, and it can be seen that its frictional interaction with the first part is minimised due to the absence of any eccentric loads on it at a time when the gear is not transmitting drive from one of its parts to another.

DESCRIPTION OF THE DRAWINGS AND OF THE PREFERRED EMBODIMENTS

Particular embodiments of the invention will now be described with reference to the accompanying drawings wherein.

Figure 1:
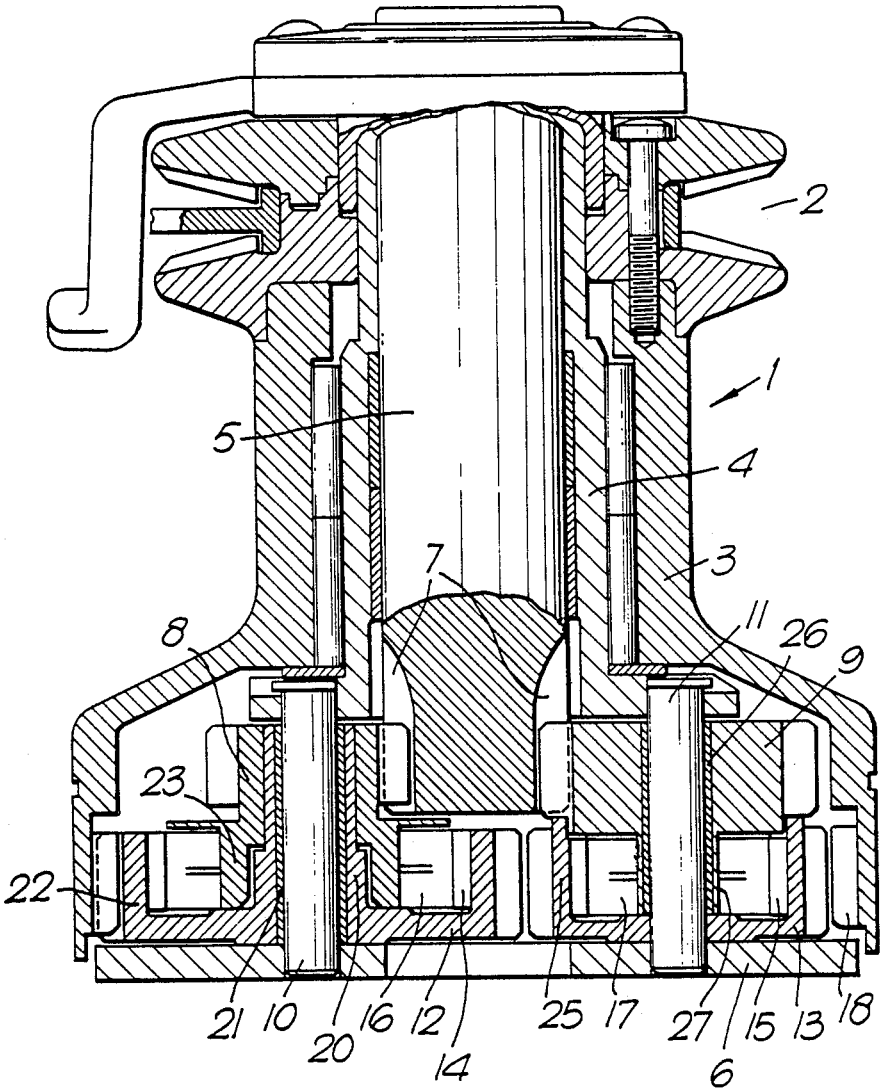
FIG. 1 is a section through a first embodiment.
Figure 3:
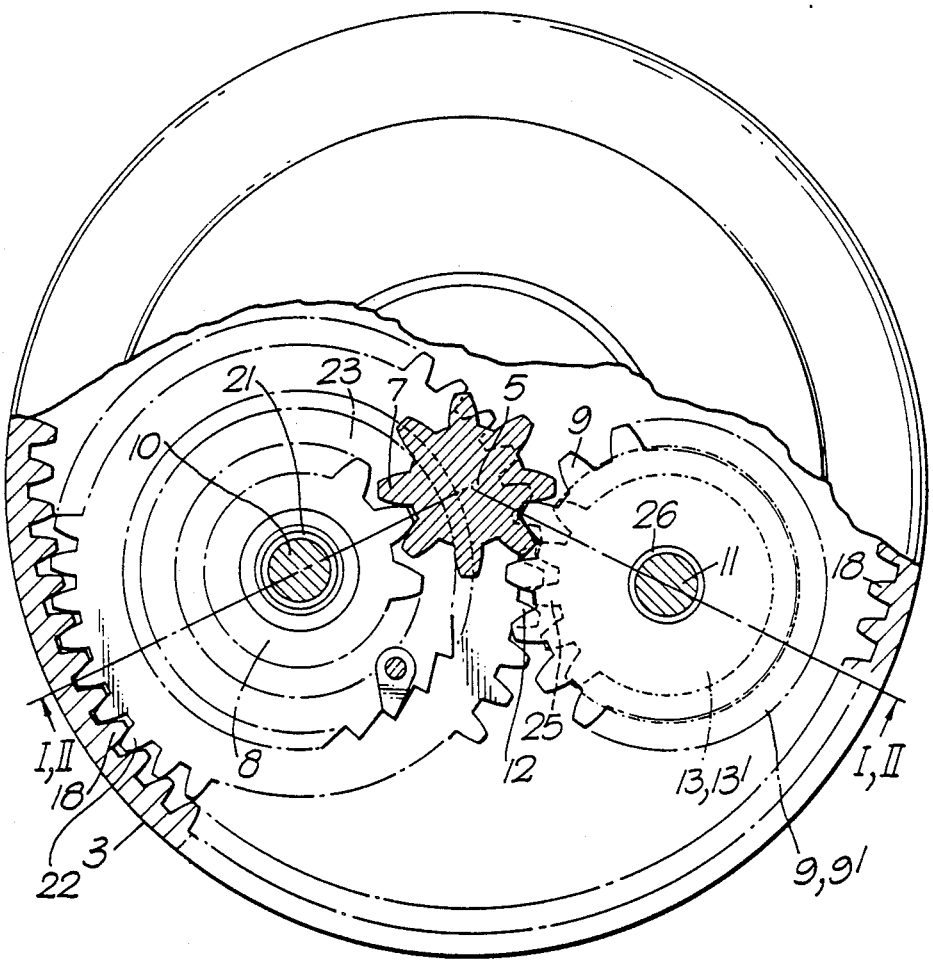
FIG. 3 shows diagrammatically a plan view of either embodiment to illustrate the angular position of the various gears of the train.

The embodiment seen in FIG. 1 is of a self-tailing winch 1 with a self-tailing channel 2 and winch drum 3 borne on a stationary column 4 and driven by a central input drive shaft 5 through a two-speed gear train seen in the lower part of the winch and mounted on its base 6. The self-tailing arrangements and the means by which the drum is supported on the column form no part of the present invention which is concerned solely with the gear trains and with at least one of the gears which is found in those trains. The winch is of a type wherein the drum is driven in one direction at successively different speed ratios automatically be reversal of the input drive shaft 5. Drive is communicated from that shaft via gear teeth 7 (formed by axial grooves formed into the diameter of the shaft 5 at its lower end) and each permanently meshing with a gear of both of the drive trains, which include respectively a first ratchet gear 8,12 and a second ratchet gear 9,13. The first ratchet gear is mounted on axle 10 and the second ratchet gear on shaft 11. The first ratchet gear has a first part 12 and the second ratchet gear 9 also has a first part 13, gear teeth on the outside of the parts 12,13 being in permanent meshing engagement with each other, the angular arrangement of axles 10,11 being seen more clearly in FIG. 3. The second part 8 of the first gear and second part 9 of the second gear both mesh with the teeth 7 on the shaft. The parts 9,13 and 8,12 respectively have unidirectional coupling between them which are formed by a ratchet track 14,15 on the parts 12,13, and pawls 16,17 on the parts 8 and 9. These are set to drive in respectively opposite senses of rotation and the arrangement is such that when the input drive shaft 5 is first turned in an anti-clockwise direction (a keyed handle being fitted in the socket in the head of the shaft for this purpose) drive is transmitted from the teeth 7 on the shaft to gear part 8 whch through its pawl 16 and ratchet track 14 drives the gear part 12 which is permanently meshed with an internal gear track 18 on the inside ofthe base of the drum 3. The shaft also rotates the gear part 9 clockwise but the pawls and ratchets 15,17 being oppositely set no drive is transmitted to the gear part 13 which is therefore free to rotate, being driven by the part 12. Whenever the shaft 5 is rotated clockwise, the drive is taken up through the pawl 17 and the ratchet track 15 to the gear part 13, which, meshing with the gear part 12 of the other ratchet gear causes drive to be transmitted through that to the gear track 18 in the drum. At this stage ratchets and pawls 14,16 are not transmitting drive and are clicking past each other, and gear parts 8,12 are counter-rotating.

The construction of both the ratchet gears is designed to minimise eccentricity and friction particularly when not transmitting drive through their own pawl and ratchet drives.

The first gear is made up of parts 8 and 12 the part 12 which provides the track of teeth has a hub with a central sleeve 20 borne through either a solid or a rolling bearing 21 on the surface of the axle 10. A flange then extends to the skirt 22 forming the outer periphery of this ratchet gear part and on the outer face of which are formed the gear teeth. On its peripheral inner face are formed the ratchets of the ratchet track 14. The other part 8 of this gear has also a sleeve within its gear track and this is mounted directly on the outer periphery of the sleeve 20 and is rotatable about it. A somewhat larger diameter sleeve projects downwardly at 23 into the recess formed between the sleeve 20 and the outer peripheral skirt 22 of the first gear part. Spring loaded pawls 16 are mounted on this downwardly projected part 23 for engagement with the ratchet track 14 upon appropriate drive of the two parts.

It can be seen that eccentric loads on the gear part 12 are taken directly onto the shaft 10, something which is particularly important when the gear part 12 is being used to transmit drive from gear part 13 to the drum and when the pawls and ratchets 14,16 are clicking past each other. The rotational bearing surface is at a low radius form the centre of rotation and there is little or no bearing load, in this condition, on the part 8, all of which adds considerably to the efficiency and lack of drag of the winch in that state.

The gear made up of gear parts 9,13 has gear part 13 being borne directly on its shaft 11 and providing an outer peripheral skirt 25 upon the outer periphery of which the gears are formed and on the inner periphery of which is seen the ratchet track 15. The gear part 9 is journalled on the shaft 11 through a sleeve or rolling contact bearing 26 and offers a downwardly projecting sleeve part 27 within which are pivottally housed the pawls 17. Again it can be seen that the two parts of the ratchet gear are rendered independent of each other in the sense of one not having to bear any eccentric load exerted on the other.

Figure 2:
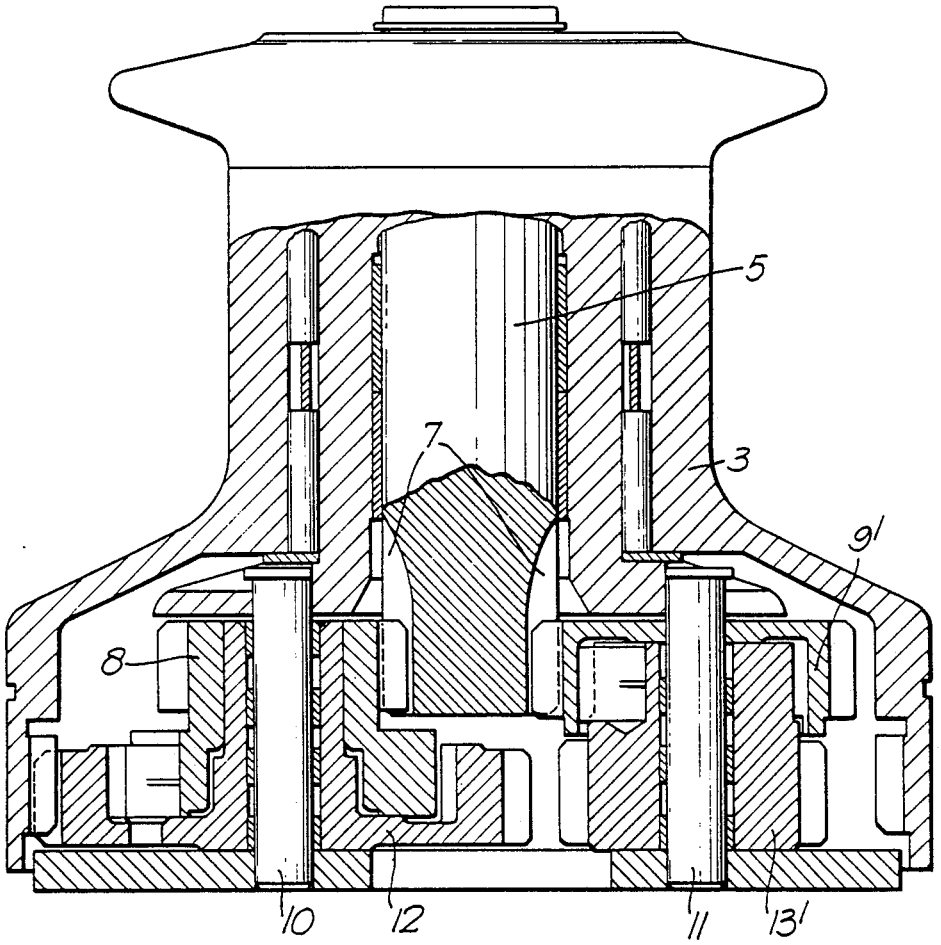
FIG. 2 is a section through a second embodiment.

FIG. 2 illustrates the invention in a simple non-selftailing winch and as before interest lies entirely in the gear train and at least one of the gears making it up. In this case the central shaft referred to as 5 once more has gear teeth 7 which engages on the one hand with a gear part 8 of a first ratchet gear 8,12 indistinguishable in construction and function, to that described with respect to FIG. 1.

The outer gear with which the teeth 7 mesh and which is mounted on an axle 11 as before shows however how the positioning and journalling of the two gear parts may be in effect inverted. The gear part here referred to as 9' although functionally identical to the gear part 9 of the first embodiment has a conformation virtually identical to that of gear part 13 of the first embodiment, while the gear part here referred to as 13' has a conformation in function virtually identical with that of gear part 9 of the first embodiment. The functioning of the second embodiment is exactly the same as that of the first in all particulars.

The construction of gear described above may be applied in principle when there are different unidirectional links between the parts of the gear—e.g. camming roller or rocker catch arrangements could be used.

What we claim is:

1. A winch having a central drive shaft and a drum, there being only two geared drive trains between the central drive shaft and the drum, each drive train including undirectional drive means, the said undirectional drive means being arranged so that drive is transmitted from the drive shaft to the drum by a different one of the drive trains according to the direction of rotation of the drive shaft, an inner wall of the drum having a gear ring defined thereon, said drive shaft having a single array of pinion teeth formed thereon, a first of the drive trains consisting of a first double gear and the second of the drive trains consisting of a second double gear, a first part of the double gears each having a gear track, the gear tracks ofthe first parts of the double gears meshing with each other and the gear track of the first part of the first double gear meshing with said gear ring, a second part of each of the double gears each having a gear track, the gear tracks of the second parts of the double gears meshing in common with said single array of pinion teeth on the shaft, the said first part of the first double gear having a sleeve-like.hub rotatably borne by an axle fixedly secured in the housing and said second part of the first double gear being rotatably supported on said sleeve-like hub of the first part over substantially the whole axial length thereof, said undirectional drive acting between the first and second parts of the first double gear.

2. A winch as in claim 1 wherein the pinion teeth on the shaft are formed by axially-directed teeth grooves in the shaft at an end portion thereof.

3. A winch as in claim 1 wherein the first two-part gear comprises a undirectional drive for communicating drive undirectionally between the parts, said undirectional drive arranged between an outer surface of the second part of the two-part gear and an inner surface of an annular flange of the first part of the two-part gear, said first gear track being on an outer surface of said flange.

4. A winch as in claim 1 wherein both said two-part gears comprise a undirectional dirve for communicating drive undirectionally between the parts, said undirectional drive being arranged between an outer surface of the said second part of the two-part gear and an inner surface of an annular flange of the first part of the two-part gear, said first gear track being on an outer surface of said flange.

5. A winch having a stationary housing with a rotatable drive shaft and a rotatable winch drum, said drive shaft having a single set of gear teeth thereon, only two gear trains for being driven from the drive shaft for communicating drive from said single set of gear teeth on said drive shaft to said drum at respectively different mechanical advantages according to the direction of rotation of the drive shaft, a final drive to said drum comprising a two-part gear, a first gear track of said two-part gear meshing permanently with a gear track on an inner surface of the drum and being on a first part of the two-part gear, said first part having a hub with a sleeve-like portion extending axially therefrom to be supported on an axle in said housing for rotation about said axle, said first gear track communicating drive to the drum in one direction of rotation of the drive shaft from a second gear track, said second gear track being in a first of the gear trains and meshing with said first track, and a third gear track on a second part of the said two-part gear and meshing with a fourth gear track, the fourth gear track being in the second of the gear trains, the second part being rotatably mounted on said sleeve like portion of the hub of the first part of said two-part gear, undirectional drive means between said parts and communicating drive to the first gear track only upon rotation of the drive shaft in the direction opposite to the one direction, said communication being by constraint of the two parts to rotate together about said axle.

6. A winch as in claim 5 wherein the undirectional drive communicates drive undirectionally between the parts of the two-part gear, said undirectional drive being arranged between an annular outer surface of the second part ofthe two-part gear and an annular inner surface of an annular flange of the first part of the two-part gear, said first gear track being on an outer surface of said flange.

7. A winch as in claim 5 wherein the second gear track is a track of a second two-part gear, with respective gear tracks on two respective parts of the second two-part gear.

8. A winch as in claim 7 wherein both said two-part gears comprise a undirectional drive for communicating drive undirectionally between the parts, said undirectional drive being arranged between an outer surface of the said inner second part of the two-part gear and an inner surface of an annular flange of the first part of the two-part gear, said first gear track being on an outer surface of said flange.

9. A winch as in claim 7 wherein the fourth gear track is a single gear track on said drive shaft and a second part of said second two-part gear has a fifth gear track, said fifth gear track meshing with said single gear track on said drive shaft.

10. A winch as in claim 5 wherein the journal in the housing is provided by a shaft fixedly secured in the housing, the first gear being rotatably supported over substantially the whole of the axial length thereof on said shaft.

* * * * *